US006139397A

United States Patent [19]

Blau et al.

[11] Patent Number: 6,139,397

[45] Date of Patent: Oct. 31, 2000

[54] DOLL HAVING SIMULATED HAIR-CUTTING FEATURE

[75] Inventors: Judith H. Blau, Eastchester, N.Y.; Gregory E. Hyman, Boca Raton, Fla.; Jon Marine, Fullerton, Calif.

[73] Assignee: Mattel, Inc., El Segundo

[21] Appl. No.: 09/491,740

[22] Filed: Jan. 27, 2000

[51] Int. Cl.[7] ..... A63H 3/44

[52] U.S. Cl. ..... 446/319; 446/394

[58] Field of Search ..... 446/319, 394, 446/489, 330, 352, 365, 475, 490, 249, 261, 260

[56] References Cited

U.S. PATENT DOCUMENTS

| | | | |
|---|---|---|---|
| Re. 27,267 | 1/1972 | Lilienstern | 446/319 |
| 2,537,536 | 1/1951 | Lilienstern | 446/319 |
| 3,156,999 | 11/1964 | Dean et al. | 446/319 |
| 3,162,976 | 12/1964 | Beebe et al. | 446/319 |
| 3,694,957 | 10/1972 | Houghton | 446/319 |
| 3,698,134 | 10/1972 | Amici et al. | 446/319 |
| 3,704,542 | 12/1972 | Suchowski | 446/319 |
| 3,808,736 | 5/1974 | Terzian et al. | 446/394 |
| 3,834,071 | 9/1974 | Terzian et al. | 446/319 |
| 4,170,085 | 10/1979 | Luke | 446/319 |
| 4,801,286 | 1/1989 | Orenstein et al. | 446/319 |
| 5,116,277 | 5/1992 | Kelley | 446/319 |

*Primary Examiner*—Jacob K. Ackun
*Assistant Examiner*—Urszula M. Cegielnik
*Attorney, Agent, or Firm*—Roy A. Ekstrand

[57] ABSTRACT

A doll head supports a pair of retracting mechanisms which provide a rotating spool upon which a quantity of hair forming a hair bundle is wound. The retracting mechanisms are operated in response to the child user squeezing the extending portion of the mechanisms at the base of the hair bundles in a simulated hair-cutting action. Each squeeze of the simulated scissors triggers an incremental spring-driven retraction of the hair bundle thereby shortening the hair bundle and simulating hair-cutting. A releasable latch mechanism operative within the retracting mechanisms allows the hair bundles to be drawn outwardly to their maximum length to repeat the hair-cutting cycle.

5 Claims, 3 Drawing Sheets

DOLL HAVING SIMULATED HAIR-CUTTING FEATURE

FIELD OF THE INVENTION

This invention relates generally to dolls or toy figures and particularly to dolls and toy figures utilizing a variable length hair bundle and supporting mechanism.

BACKGROUND OF THE INVENTION

A variety of dolls have been provided by practitioners in the toy arts for many years which enjoy the common characteristic of simulated hair growth or hair length change. While such dolls employ a number of different apparatus and mechanisms for the changing of hair length, most include the common structural features of a hollow head having one or more apertures in the crown portion thereof. Such dolls further include a bundle of hair fibers passing through the aperture having one end free outside the doll's head and the remaining end secured internally to some type of retracting mechanism. The retracting mechanism is typically supported within the doll head or within a hollow torso cavity formed in the doll body. For example, U.S. Pat. No. 3,162,976 issued to Beebe, et al. sets forth a DOLL, TOY FIGURE AND THE LIKE WITH AN ADJUSTABLE LOCK OF HAIR having a doll supporting a hollow head and torso within which a wind-up mechanism is supported. A cord is wound upon the wind-up mechanism and passes upwardly through the torso and head and is secured to the interior end of a lock of hair. The lock of hair passes outwardly through an aperture formed in the doll's head.

U.S. Pat. No. 3,156,999 issued to Dean, et al. sets forth a HAIR DISPENSING HOLDER FOR DOLL'S HEAD having a doll supporting a hollow head having an elongated aperture or slot formed therein. A quantity of hair is passed through the slot and is received within the interior of the doll's head.

U.S. Pat. No. 2,537,536 issued to Lilienstern sets forth a DOLL HEAD WITH HAIR having a doll head defining an upper aperture and an interior cavity. A quantity of hair is received within the interior of the doll head and passes outwardly through the aperture formed therein.

U.S. Pat. No. Re. 27,267 issued to Lilienstern sets forth a RETRACTABLE HAIR DOLL having a hollow head and torso. The head defines an aperture in the upper surface thereof and a bundle of hair passes through the aperture. The interior end of the hair bundle is secured to a weight or spring for retraction and a friction mechanism is secured about the hair bundle to maintain it at a given length or retraction.

U.S. Pat. No. 3,698,134 issued to Amici, et al. sets forth a DOLL HAVING ADJUSTABLE LOCK OF HAIR in which a doll defines a hollow head and torso. The head defines an aperture in the upper portion thereof and a quantity of hair formed in a bundle passes through the aperture. The interior end of the hair bundle is secured to a cord which in turn is wound upon an internal winding mechanism.

U.S. Pat. No. 4,801,286 issued to Orenstein, et al. sets forth a DOLL WITH SIMULATED HAIR GROWTH in which a doll head and upper torso supports an elongated tube coupled to an aperture formed in the upper surface of the doll head. A shuttle or slide is movably received within the tube and secured to a wind-up mechanism. A quantity of hair is joined to the shuttle and is movable therewith.

U.S. Pat. No. 5,116,277 issued to Kelley sets forth a DOLL HAVING VARIABLE LENGTH HAIR SEGMENT in which a hollow head and torso receive a quantity of hair passing through an aperture formed in the doll's head. A drawstring is secured to the interior end of the hair bundle and extends outwardly through the rear of the doll's torso. The outer end of the pullstring passes through an aperture formed in the doll torso and is secured to a comb.

U.S. Pat. No. 4,170,085 issued to Luke sets forth a DOLL WITH GROWING HAIR having upper and lower torso portions rotatable relative to each other. A quantity of hair is retractably supported in the doll head and is coupled to an internal mechanism operated in response to rotational movement between the upper and lower torso portions to retract the hair bundle.

U.S. Pat. No. 3,834,071 issued to Terzian, et al. sets forth a DOLL WITH COORDINATED HEAD AND TORSO MOVEMENT having an upper and lower torso portion rotatable relative to each other. The doll head is also rotatable with respect to the upper torso. A motor within the lower torso portion is connected to the upper torso portion and head for driving the upper torso portion and head in a to-and-fro twisting motion.

U.S. Pat. No. 3,808,737 issued to Terzian, et al. sets forth a HAIR STYLE FIGURE AND ACCESSORIES having a simulated head supporting a quantity of fixed hair. A centrally located aperture receives a bundle of hair in a detachable attachment.

U.S. Pat. No. 3,704,542 issued to Suchowski sets forth a DOLL having a hollow body including a turnable head defining an aperture in its upper portion. A lock of hair extends through the aperture and is retracted by a rubber band extending between the hair lock and one of the doll's legs.

U.S. Pat. No. 3,694,957 issued to Houghton sets forth a GROWING HAIR DOLL having a doll defining a head and torso which in turn defines a hair receiving passage. A quantity of hair passes through the hair receiving passage and is secured to a resilient band at its interior end. A friction grip is provided which operates to maintain the hair extension at any given length.

While the foregoing described prior art devices have in some respects improved the art and in some instances enjoyed commercial success, there remains nonetheless a continuing need in the art for evermore improved, interesting and amusing doll hair play features.

SUMMARY OF THE INVENTION

Accordingly, it is a general object of the present invention to provide an improved hair play doll. It is a more particular object of the present invention to provide an improved hair play doll which simulates the hair-cutting procedure in an amusing play manner.

In accordance with the present invention, there is provided a doll comprising: a head having an interior cavity and at least one aperture therein; at least one hair retracting mechanism having a hair guide extending through the at least one aperture, the hair guide defining a hair passage, the at least one hair retracting mechanism having a squeeze trigger and a rotatable spool and means for incrementally rotating the spool in response to squeezing the trigger; at least one hair bundle having an end passing through the hair passage and coupled to the spool such that incremental rotation of the spool causes an incremental portion of the at least one hair bundle to be retracted into the hair guide; and a simulated toy scissors having closable jaws constructed to squeeze the trigger to cause the incremental portion of the at least one hair bundle to be retracted by the at least one retracting mechanism whereby the at least one hair bundle appears to be shortened.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
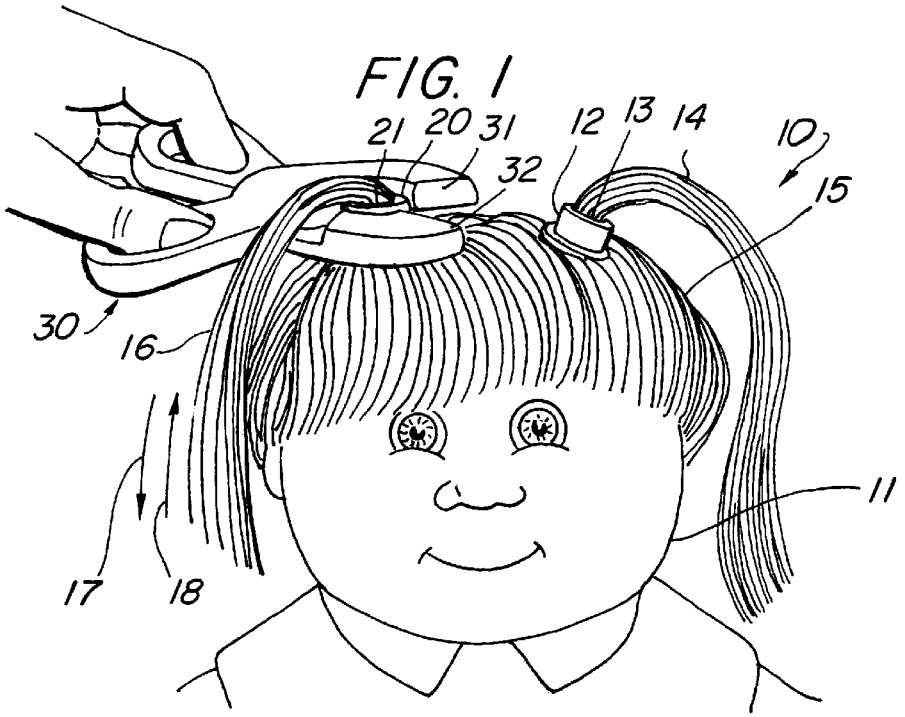
FIG. 1 sets forth a front view of a doll having a simulated hair-cutting feature constructed in accordance with the present invention.

FIG. 1 sets forth a front view of a doll constructed in accordance with the present invention and generally referenced by numeral 10. Doll 10 includes a head 11 having a quantity of fixed hair 15 supported thereon by a conventional rooting process (not shown). Doll 10 further includes a hair guide 12 having a hair passage 13 formed therein. Hair guide 12 extends upwardly through an aperture formed in head 11 (not shown) and, in accordance with the present invention, supports a hair bundle 14. In further accordance with the present invention, doll 10 includes a hair guide 20 defining a hair passage 21 which receives a hair bundle 16.

In accordance with an important aspect of the present invention and as is set forth below in greater detail, hair bundles 14 and 16 are retractable through hair guides 12 and 20 respectively through a simulated hair-cutting process. This simulated hair-cutting process is actuated by a simulated scissors 30 which is manipulated by the child user in the manner shown in FIGS. 1 and 2. Simulated scissors 30 is preferably formed of a molded plastic material or the like and supports a pair of movable jaws 31 and 32. FIG. 1 shows a simulated hair-cutting process in which the child user manipulates jaws 31 and 32 upon hair guide and squeezes jaws 31 and 32 against hair guide 20. Each squeezing movement of scissors 30 upon hair guide 20 causes an incremental retraction of hair bundle 16 in the direction indicated by arrow 18. The mechanism by which this incremental hair bundle retraction is produced is set forth below in greater detail. Suffice it to note here that each time the child user squeezes hair guide 20 between jaws 31 and 32, hair bundle 16 retracts in the direction indicated by arrow 18 by a predetermined length increment. The result is a simulation of shortening hair bundle 16 each time the user closes scissors 30.

In further accordance with the present invention and as is also set forth below in greater detail, the amount of hair bundle 16 extending outwardly through hair guide 20 may be increased by drawing hair bundle 16 in the direction indicated by arrow 17 to "lengthen" the hair bundle. As a result, the child user may repeatedly lengthen hair bundle 16 and simulate a hair-cutting action to shorten the hair bundle providing a simulating hair-cutting play activity.

Hair bundle 14 is supported in a substantially identical manner to hair bundle 16 and thus is capable of being incrementally shortened by the user actuating scissors 30 upon hair guide 12 in the above-described manner to incrementally retract hair bundle 14. Further, hair bundle 14 is also capable of being lengthened by drawing a quantity of the hair bundle outwardly from hair guide 12.

Thus, the child user is able to repeatedly undertake hair lengthening and simulating hair-cutting by drawing a quantity of hair outwardly for hair bundles 16 and/or 14 and thereafter utilizing scissors 30 in the manner described above to simulate cutting.

Figure 2:
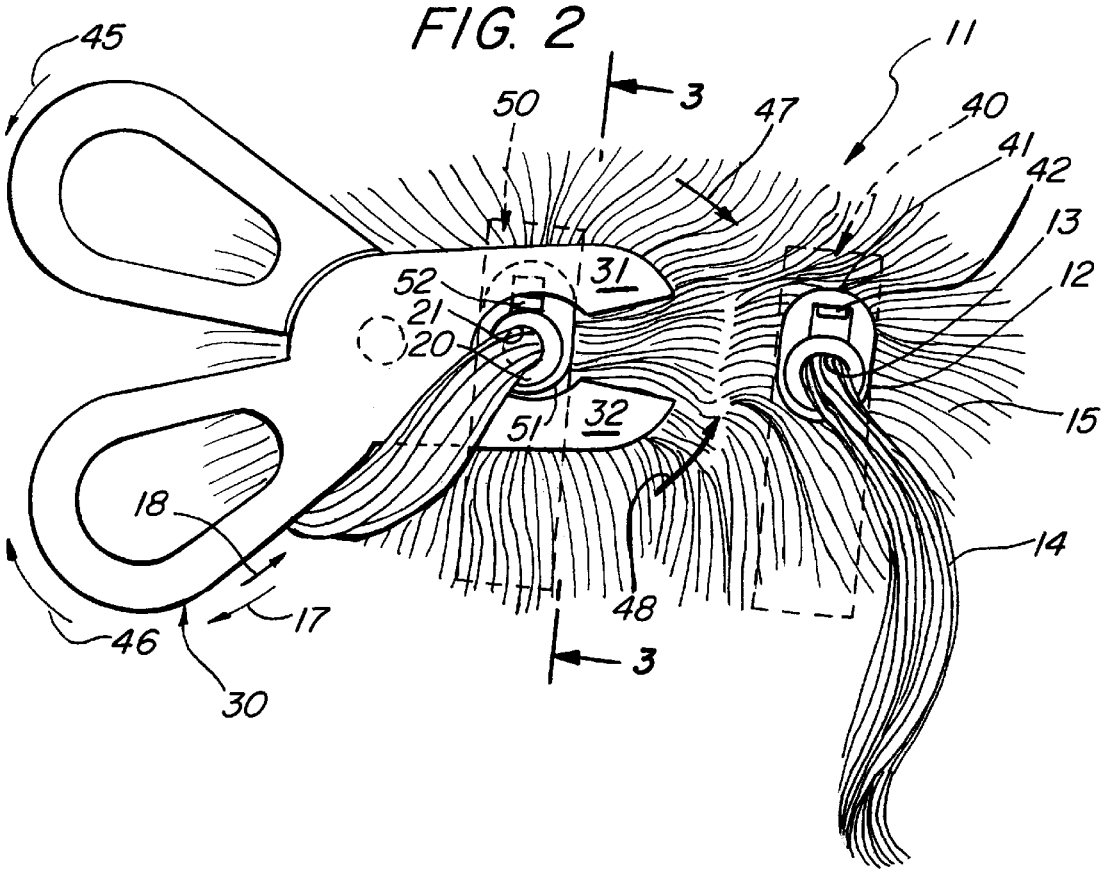
FIG. 2 sets forth a partial top view of the simulated hair-cutting feature of the present invention doll.

FIG. 2 sets forth a partial top view of head 11 showing the simulating hair-cutting process in greater detail. As described above, head 11 supports a quantity of fixed hair 15 in accordance with a conventional rooting process (not shown). By means set forth below in greater detail, head 11 supports a hair guide 12 having a hair passage 13 formed therein. Hair guide 12 further supports a plate 41 within which a tab 42 is movably supported. Similarly, head 11 supports a hair guide 20 having a hair passage 21 defined therein. By way of further similarity, hair guide 20 includes a plate 51 having a movable tab 52 supported thereby. A pair of hair bundles 14 and 16 are received within hair passages 13 and 21 respectively. Head 11 further supports a pair of hair retracting mechanisms 40 and 50 which are operative upon hair bundles 14 and 16 in the manner described below to provide retraction and extension of the hair bundles to simulate growth and hair-cutting processes.

A simulated scissors 30 includes a pair of movable jaws 31 and 32. In the play pattern shown in FIG. 2, scissors 30 is received upon and embraces hair guide 20 and tab 52 thereof. As the user squeezes scissors 30 inwardly in the manner indicated by arrows 45 and 46, jaws 31 and 32 are correspondingly closed in the directions indicated by arrows 47 and 48. This closing or squeezing movement of jaws 31 and 32 moves tab 52 inwardly against hair guide 20. By means set forth below in greater detail, hair retracting mechanism 50 responds to the inward movement of tab 52 against hair guide 20 by incrementally retracting a portion of hair bundle 16 in the direction indicated by arrow 18. Thus, each time the child user squeezes scissors 30 upon hair guide 20 and tab 52, an increment of hair bundle 16 is retracted through hair passage 21 in the direction indicated by arrow 18.

The child user is able to restore hair bundle 16 to its maximum length by simple drawing hair bundle 16 outwardly from hair passage 21 in the direction indicated by arrow 17. Once hair bundle 16 has been maximally withdrawn or extended, hair retracting mechanism 50 maintains the length of hair bundle 16 until the above-described simulated hair-cutting process is again undertaken.

Hair retracting mechanism 40 is substantially identical to hair retracting mechanism 50. Accordingly, hair bundle 14 may be incrementally retracted through hair passage 13 as the user places scissors 30 upon hair guide 12 and tab 42 in the manner shown for hair guide 20 and tab 52. By way of further similarity of operation, each squeeze upon hair guide 12 drives tab 42 against hair guide 12 causes hair retracting mechanism 40 to incrementally retract hair bundle 14 to again simulate hair-cutting. Hair bundle 14 may be returned to its maximum length by the user simply grasping hair bundle 14 and drawing it outwardly through hair passage 13.

Thus, there is provided a simulated hair-cutting play pattern in which the child user is able to employ a completely simulated scissors in repeated hair-cutting operations upon the present invention doll and observe the resulting shortening of the doll's hair.

Figure 3:
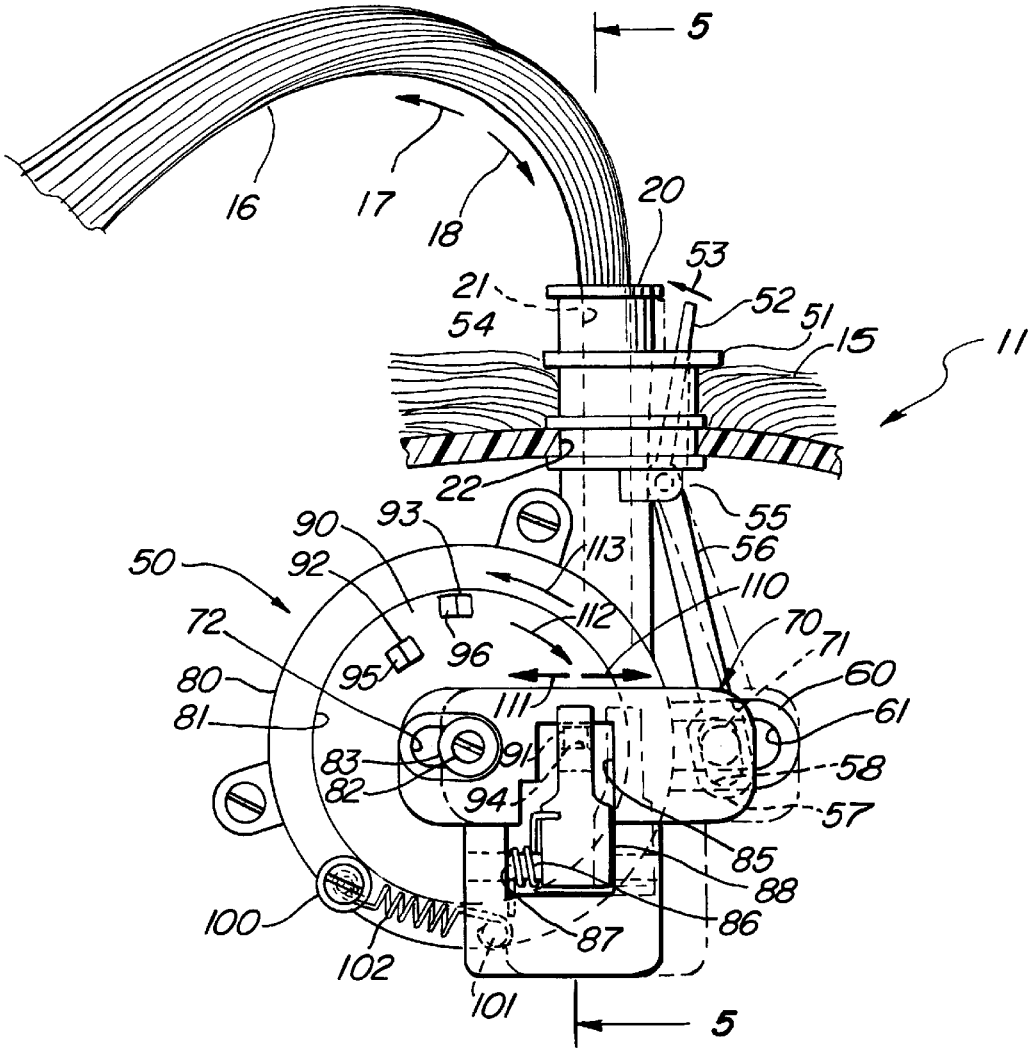
FIG. 3 sets forth a partial section view of the hair-cutting simulation mechanism of the present invention doll taken along section lines 3—3 in FIG. 2.

FIG. 3 sets forth a partially sectioned side view of head 11 showing hair retracting mechanism 50 supported in combination with hair guide 20. It will be understood that hair retracting mechanism 40 (seen in FIG. 2) is substantially identical to hair retracting mechanism 50 and thus the descriptions and structures shown for hair retracting mechanism 50 shown in FIGS. 3 and 5 will be understood to apply equally well and be equally descriptive of hair mechanism 40 (seen in FIG. 2).

More specifically, head 11 defines an aperture 22 and supports a quantity of fixed hair 15. Hair retracting mechanism 50 includes an upwardly extending guide housing 54 having hair guide 20 at the upper end thereof. Guide housing 54 further supports a plate 51. Hair guide 20 defines a hair passage 21 which extends downwardly through guide housing 54 and which receives a hair bundle 16. A tab 52 is movable within plate 51 and is joined to a downwardly extending lever 56 at a pivot 55. Lever 56 further includes an end 57 defining an elongated slot 58 therein.

Figure 5:
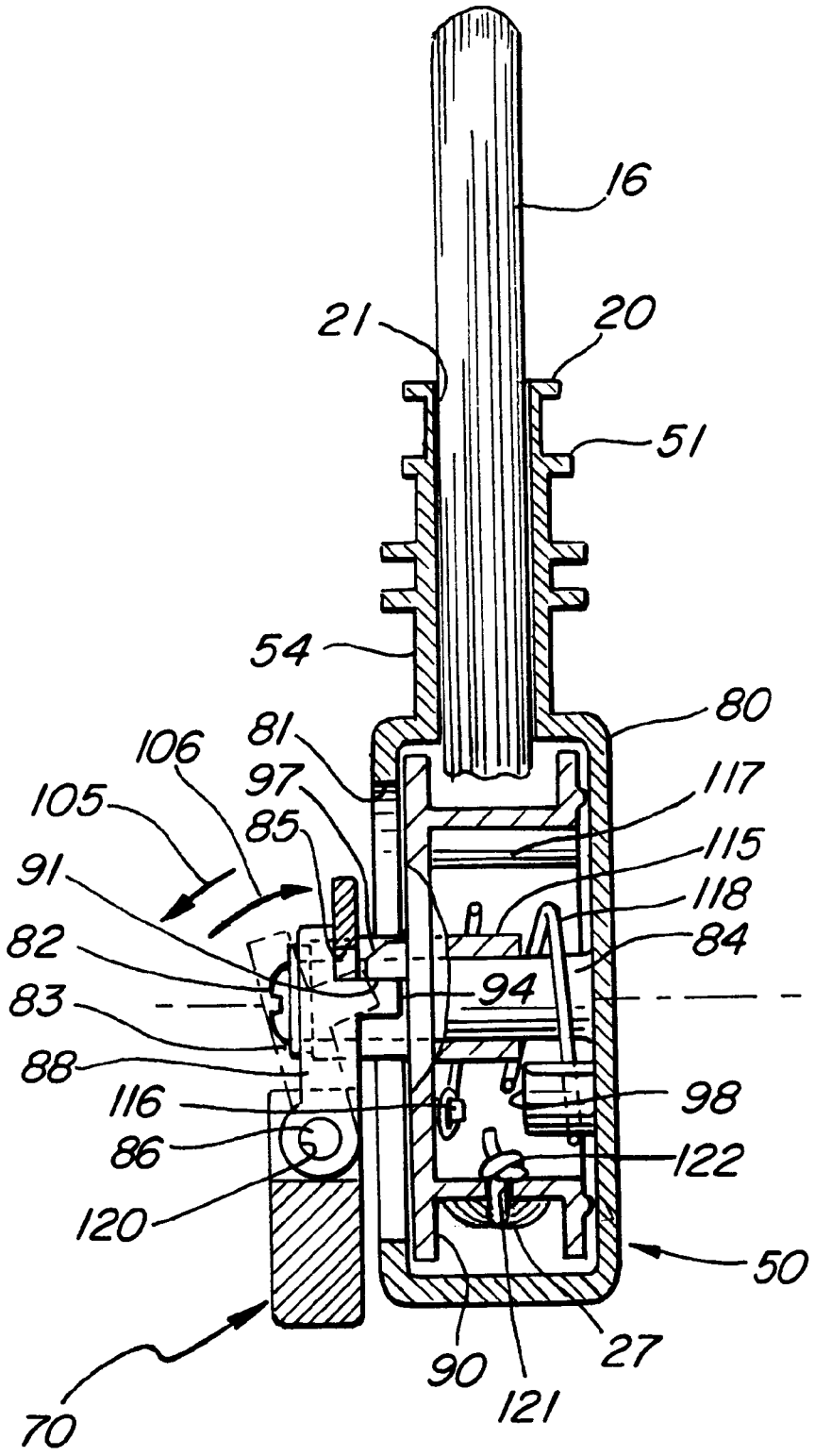
FIG. 5 sets forth a partial section view of the hair supporting and retracting mechanism of the present invention doll taken along section lines 5—5 in FIG. 3.

Hair retracting mechanism 50 further includes a generally cylindrical drum 80 having an opening 81 formed therein. Drum 80 receives a spool 90 which in the manner set forth below in FIG. 5 is rotatably supported within drum 80. Spool 90 further supports a plurality of tabs 91, 92 and 93. Tabs 91, 92 and 93 define respective angled facets 97, 95 and 96. As is better seen in FIG. 5, drum 80 includes a post 84 which rotatably supports spool 90 within drum 80. A fastener 82 having a washer 83 supported thereon is secured to post 84 to captivate spool 90.

Hair retracting mechanism 50 further includes a slide 70 having an opening 85 formed therein. Slide 70 further includes a shaft 86 having a spring 87 received thereon together with a pivotally supported latch 88. Latch 88 defines a tooth 94 which extends through opening 85. Spring 87 is coupled to latch 88 so as to provide a spring force which urges latch 88 into opening 85. Slide 70 further includes a slide pin 71 which passes through a slot 61 formed in guide 60 and in which is received within slot 58 of end 57 of lever 56. Guide 60 is joined to drum 80 and is preferably integrally formed with drum 80. Slide 70 further defines a slot 72 which receives post 84. Slide 70 further includes a post 101 which receives one end of a spring 102. The remaining end of spring 102 is secured to drum 80 at a post 100 formed thereon.

In operation, slide 70 is movable in the directions indicated by arrows 110 and 111 with respect to drum 80. The action of spring 102 upon slide 70 urges slide 70 in the direction indicated by arrow 111. Thus, in the absence of force applied to tab 52, slide 70 assumes the position shown in solid-line representation in FIG. 3. In response to the simulated hair-cutting play illustrated above in FIG. 2, tab 52 is pivotable about pivot 55 in the direction indicated by arrow 53 as the child squeezes simulated scissors 30 (seen in FIG. 2). The pivotable movement of tab 52 in the direction indicated by arrow 53 produces a corresponding movement of lever 56 and slide 70 in the direction indicated by arrow 110. The maximum movement of slide 70 and lever 56 in the direction indicated by arrow 110 is shown in dashed-line representation in FIG. 3. When the force against tab 52 is released, spring 102 draws slide 70 in the direction indicated by arrow 111 which in turn pivots lever 53 correspondingly and pivots tab 52 away from hair guide 20 in the opposite direction to that indicated by arrow 53.

Of importance with respect to the present invention, the lateral movement of slide 70 displaces tooth 94 of latch 88 from tab 91 of spool 90. By means set forth below in FIG. 5 in greater detail, spool 90 is spring-biased to rotate in the direction indicated by arrow 112. With slide 70 in the position shown in solid-line representation in FIG. 3, the interference of tooth 94 of latch 88 against tab 91 prevents rotation of spool 90 in the direction indicated by arrow 112. As is also shown in FIG. 5, the interior end of hair bundle 16 is secured to spool 90 by a fastening cord 122. Accordingly, as the user applies the above-described simulated cutting action to hair guide 20 which squeezes tab 52 in the direction indicated by arrow 53, the resulting movement of slide 70 in the direction indicated by arrow 110 moves tooth 94 away from tab 91 releasing spool 90. In response to the return force of spring 118 (seen in FIG. 5) operative upon spool 90, spool 90 then rotates in the direction indicated by arrow 112. As spool 90 rotates, hair bundle 16 is drawn inwardly in the direction indicated by arrow 18 through hair passage 21. The extent of rotation of spool 90 and thereby the extent of retraction of hair bundle 16 is determined by the position of slide 70 as spool 90 continues to rotate. In other words, if the child user maintains the squeezing action of scissors 30 upon tab 52 in the manner seen in FIG. 2, tooth 94 of latch 88 will be positioned in alignment with tab 93 of spool 90 and the rotation of spool 90 will be stopped at the position of tab 93. If, however, the child user releases tab 52, tooth 94 will be moved to alignment with tab 92. As a result, as spool 90 continues to rotate in the direction indicated by arrow 112, the rotation will be halted as tab 92 contacts tooth 94.

In the anticipated play pattern of the present invention, incremental movement of hair bundle 16 is provided as the child user squeezes hair guide 20 and tab 52 allowing spool 90 to rotate abruptly bringing tab 93 into contact with tooth 94 of latch 88. This happens very quickly and most likely before the child user can release the force against tab 52. Once the child user releases the scissors force against tab 52, spring 102 quickly moves latch 88 and slide 70 in the direction indicated by arrow 111 to the solid-line position which allows a short incremental rotation of spool 90 and corresponding retraction of hair bundle 16 until tab 92 contacts tooth 94 of latch 88. As the child user again squeezes scissors 30 in the manner seen in FIG. 2, tab 52 is again moved toward hair guide 20 again releasing spool 90 and allowing a further incremental retraction of hair bundle 16.

As mentioned above, hair bundle 16 may be withdrawn from head 11 in the direction indicated by arrow 17 by simply grasping hair bundle 16 and pulling it from head 11. When a force is applied to hair bundle 16 in the direction indicated by arrow 17, spool 90 is rotated against return spring 118 (seen in FIG. 5) to permit hair withdrawal. The pivotal support of latch 88 upon shaft 86 together with spring 87 cooperates with angled facets 95, 96 and 97 of tabs 92, 93 and 91 respectively to allow the tabs to pass beneath tooth 94 and thereby allow retraction. In essence, the angled facets pivot latch 88 away from spool 90 overcoming the force of spring 87.

Figure 4:
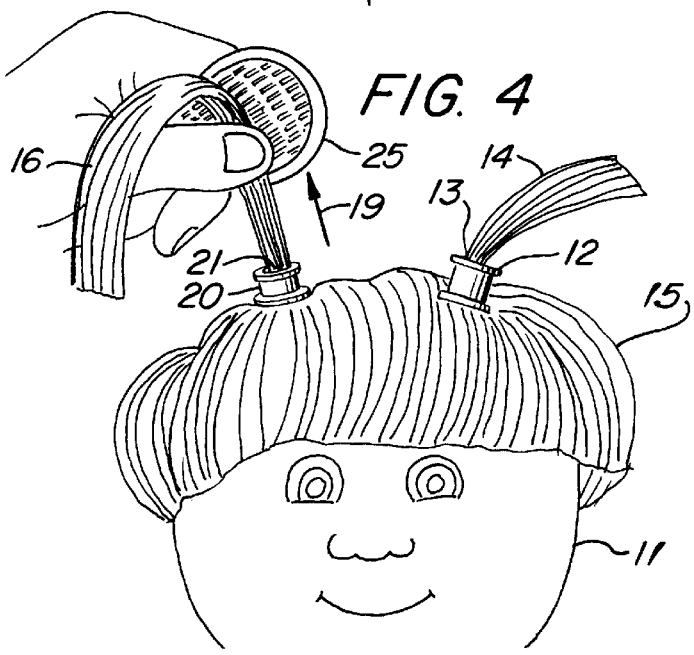
FIG. 4 sets forth a front view of the present invention doll in the hair extending operation of the simulated hair-cutting feature.

FIG. 4 sets forth head 11 supporting fixed hair 15 and illustrating a further play pattern variation of the present invention doll. As described above, head 11 support hair guides 12 and 20 having hair passages 13 and 14 which in turn receive hair bundles 14 and 16 respectively. In the play pattern variation illustrated in FIG. 4, a hair brush 25 is applied to hair bundle 16 and used in a brushing motion upon hair bundle 16 to apply a drawing force in the direction indicated by arrow 19. Thus, as an alternative to simply grasping hair bundle 16 and pulling it from head 11, the user is able to use brush 25 in a more realistic process for withdrawing or extending hair bundle 16.

FIG. 5 sets forth a section view of hair retracting mechanism 50 taken along section lines 5—5 in FIG. 3. As described above, hair guide 20 is supported upon head 11 (seen in FIG. 3) and defines a hair passage 21 within which a hair bundle 16 is received. A guide housing 54 includes a plate 51 and extends downwardly from hair guide 20 to a generally cylindrical drum 80. Retracting mechanism 50 further includes a spool 90 rotatably supported within drum 80 upon a post 84 formed therein. Post 84 is received within a boss 115 formed on the interior of spool 90. Drum 80 defines an opening 81 which exposes one side of spool 90 which as is better seen in FIG. 3 supports a plurality of tabs 91, 92 and 93. In the position shown in FIG. 5, tab 91 having an angled facet 97 is shown extending outwardly from spool 90 through opening 81. Drum 80 further includes a fence 98 which cooperates with a limit stop 117 formed on the interior of spool 90 to limit the rotation of spool 90 upon post 84 within drum 80. Thus, in each direction of rotation, limit stop 117 contacts fence 98 and thereby prevents further rotation of spool 90. Spool 90 further defines an aperture 121 which receives one end of a cord 122. Cord 122 is shown tied in a conventional knot to secure the cord end within spool 90. It will be apparent, however, that other forms of attachment may be used without departing from the spirit and scope of the present invention. The remaining end of cord 122 is joined to end 27 of hair bundle 16 to secure hair bundle 16 upon spool 90. Spool 90 further defines an inwardly extending spring tab 116 which receives one end of return spring 118. Spring 118 encircles boss 115 and post 84 and is secured to fence 98 at its opposite end. Spring 118 operates to provide a return spring force which urges spool 90 in the direction of rotation indicated by arrow 113 in FIG. 3.

Retracting mechanism 50 further includes a slide 70 having a shaft 86 which is received within bore 120 of latch 88. Latch 88 is pivotally supported upon shaft 86 and is urged inwardly in the direction indicated by arrow 106 by return spring 87 (seen in FIG. 3). Latch 88 includes an inwardly extending tooth 94 which passes through opening 85 of slide 70. Tooth 94 is normally positioned in the manner shown in solid-line representation in FIG. 5 such that tooth 94 is positioned in alignment with either of the plurality of teeth supported upon spool 90 in response to the lateral position of slide 70 as described above in FIG. 3. In the position shown in FIG. 5, tooth 94 is in contact with tab 91 of spool 90.

In the position shown, tooth 94 will continue to contact tab 91 and prevent rotation of spool 90 until slide 70 is moved laterally in the manner illustrated in FIG. 3 thereby releasing spool 90 and allowing an increment of hair bundle 16 to be wound into drum 80 upon spool 90. It will be recalled that retracting mechanism 50 is operative to allow hair bundle 16 to be drawn from retracting mechanism 50 by pulling hair bundle 16 and causing spool 90 to rotate against the force of spring 118. In order to facilitate the rotation of spool 90 in this manner, each of the extending tabs such as tab 91 of spool 90 defines an angled facet such as facet 97. Thus, as facet 97 passes upwardly against the underside of tooth 94, the angle of facet 97 overcomes the force of return spring 87 (seen in FIG. 3) causing latch 88 to pivot outwardly in the direction indicated by arrow 105. This outward pivotal position of latch 88 is shown in dashed-line representation in FIG. 5. In this manner, spool 90 may be rotated in the direction indicated by arrow 113 in FIG. 3 as hair bundle 16 is withdrawn from spool 90. Each tab having an angled facet is able to force latch 88 outwardly and pass beneath tooth 94 during this rotation.

What has been shown is a doll having a simulated hair-cutting feature in which a pair of hair bundles are supported by retracting hair mechanisms within the doll head. The retracting mechanisms are operative in response to application of a simulated scissor to the hair bundle to incrementally withdraw or retract a portion of the hair bundle. This in turn gives the appearance of hair-cutting in that repeated operation of the simulated scissors results in shortening the hair bundle.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll comprising:

a doll head having an interior cavity and a pair of apertures formed therein;

a pair of hair guides each defining a hair passage;

a pair of retracting mechanisms joined to said hair guides and each having a rotatable spool and means for incrementally rotating said spool;

a pair of release mechanisms supported on said pair of hair guides operative to cause incremental rotation of said spools;

a pair of hair bundles each having an end portion passing through each of said hair passages and coupled to each of said spools; and a simulated toy scissors having a pair of closing jaws, said toy scissors being constructed to squeeze either of said hair guides with release mechanism to cause said incremental retraction of one of said hair bundles and simulate shortening thereof.

2. The doll set forth in claim 1 wherein said pair of release mechanisms each include a tab and lever pivotally supported upon said retracting mechanisms, said tab being positioned adjacent said hair guides.

3. The doll set forth in claim 2 wherein said pair of retracting mechanisms each include a spring coupled to said spools urging said spools toward rotation in a direction retracting said hair bundles and wherein said pair of release mechanisms each include a slide moved by one of said levers between a first position engaging one of said spools and a second position releasing one of said spools.

4. The doll set forth in claim 3 wherein said pair of release mechanisms each include at least one tab on said spool and a tooth supported on said slide.

5. A doll comprising:

a head having an interior cavity and at least one aperture therein;

at least one hair retracting mechanism having a hair guide extending through said at least one aperture, said hair guide defining a hair passage, said at least one hair retracting mechanism having a squeeze trigger and a rotatable spool and means for incrementally rotating said spool in response to squeezing said trigger;

at least one hair bundle having an end passing through said hair passage and coupled to said spool such that incremental rotation of said spool causes an incremental portion of said at least one hair bundle to be retracted into said hair guide; and a simulated toy scissors having closable jaws constructed to squeeze said trigger to cause said incremental portion of said at least one hair bundle to be retracted by said at least one retracting mechanism whereby said at least one hair bundle appears to be shortened.

* * * * *